US010403203B2

(12) United States Patent
Kim

(10) Patent No.: US 10,403,203 B2
(45) Date of Patent: Sep. 3, 2019

(54) ORGANIC LIGHT EMITTING DISPLAY DEVICE

(71) Applicant: LG DISPLAY CO., LTD., Seoul (KR)

(72) Inventor: JungChul Kim, Paju-si (KR)

(73) Assignee: LG DISPLAY CO., LTD., Seoul (KR)

( * ) Notice: Subject to any disclaimer, the term of this patent is extended or adjusted under 35 U.S.C. 154(b) by 39 days.

(21) Appl. No.: 15/594,056

(22) Filed: May 12, 2017

(65) Prior Publication Data

US 2017/0345368 A1 Nov. 30, 2017

(30) Foreign Application Priority Data

May 31, 2016 (KR) ..... 10-2016-0067619

(51) Int. Cl.
*G09G 3/36* (2006.01)
*G09G 3/30* (2006.01)
*G09G 3/3233* (2016.01)

(52) U.S. Cl.
CPC ... *G09G 3/3233* (2013.01); *G09G 2300/0417* (2013.01); *G09G 2300/0809* (2013.01); *G09G 2300/0819* (2013.01); *G09G 2310/0262* (2013.01); *G09G 2310/0297* (2013.01); *G09G 2320/0233* (2013.01); *G09G 2320/0247* (2013.01); *G09G 2320/0257* (2013.01); *G09G 2320/046* (2013.01); *G09G 2330/02* (2013.01); *G09G 2370/047* (2013.01)

(58) Field of Classification Search
CPC .. G09G 3/32; G09G 3/30; G09G 3/36; G09G 5/00; G06F 3/038
See application file for complete search history.

(56) References Cited

U.S. PATENT DOCUMENTS 9,189,991 B2 * 11/2015 Ka ..... G09G 3/3233
2011/0025586 A1 * 2/2011 Lee ..... G09G 3/003 345/76
2015/0042692 A1 * 2/2015 Kim ..... G09G 3/3233 345/690
2015/0116302 A1 * 4/2015 Kim ..... G09G 3/006 345/212
2015/0145754 A1 * 5/2015 Yang ..... G09G 3/3233 345/76
2016/0300534 A1 * 10/2016 Kishi ..... G09G 3/3233
2017/0154577 A1 * 6/2017 Lee ..... G09G 3/3233

* cited by examiner

*Primary Examiner* — Pegeman Karimi
(74) *Attorney, Agent, or Firm* — Birch, Stewart, Kolasch & Birch, LLP

(57) ABSTRACT

The present disclosure relates to an organic light emitting display device which is implemented to reduce or suppress the residual image and the flicker. According to an embodiment, a circuit includes an organic light emitting diode disposed between a first node and a first power source, a driving transistor disposed between the first node and a second power source and driving the organic light emitting device, a first transistor transmitting a data signal to the driving transistor, and a first control transistor disposed between the first node and a second node. The first control transistor applies a reverse current to the driving transistor during a first period and holes accumulated on the active layer of the driving transistor are removed during the first period, whereby a current path efficiency is improved.

18 Claims, 8 Drawing Sheets

ORGANIC LIGHT EMITTING DISPLAY DEVICE

CROSS-REFERENCE TO RELATED APPLICATIONS

This application claims the priority of Korean Patent Application No. 10-2016-0067619 filed on May 31, 2016, in the Korean Intellectual Property Office, the disclosure of which is fully incorporated herein by reference.

BACKGROUND

Field

The present disclosure relates to an organic light emitting display device, and more particularly, to an organic light emitting display device including a pixel structure which improves a restoration residual image.

Description of the Related Art

In accordance with development of information technology, the market for display devices serving as connection media between users and information is increased. Various electronic devices such as a mobile phone, a tablet, a navigation, a notebook, a television, a monitor, and a public display are deeply embedded in a daily life and a display device is basically mounted in such electronic devices so that a demand for the display device is also increasing day by day. Examples of the display device include a liquid crystal display device and an organic light emitting display device.

The liquid crystal display device is basically configured by one transistor and one capacitor for every pixel. Further, the organic light emitting display device is basically configured by two transistors and one capacitor. Therefore, as compared with the liquid crystal display device, the organic light emitting display device is disadvantageous in achieving a high integration degree.

Moreover, in order to compensate characteristic deviation and degradation of transistors in the pixel of the organic light emitting display device, three or more transistors may be further used in each pixel. As described above, when an internal compensation circuit is further provided in the region of the pixel, a degree of freedom of a pixel circuit design may be inevitably significantly lowered in a product which requires a high integration degree.

In order to address the above-described problems, various external compensation circuits and external compensation driving methods which provide the compensation circuit in the outside of the pixel, instead of forming the compensation circuit in the pixel, have been studied.

A plurality of transistors configuring the organic light emitting display device includes an active layer and a gate insulating layer. The active layer may be formed of an oxide semiconductor, an amorphous silicon (a-Si) semiconductor, a polycrystalline silicon (poly-Si) semiconductor, or an organic semiconductor. The gate insulating layer may be silicon oxide (SiOx), silicon nitride (SiNx), or a multiple layer thereof.

When a driving transistor which drives the organic light emitting diode is a P-type semiconductor, if the driving transistor is turned on, a plurality of holes passes through the active layer. In this case, some of the holes are attracted to a potential of a gate electrode to be accumulated on the gate insulating layer.

The holes accumulated on the gate insulating layer may interrupt the flow of a current, which may cause screen defects such as a residual image. Therefore, in order to remove the above-mentioned defects, the holes accumulated on the gate insulating layer need to be removed.

When the transistor is turned off, the holes accumulated on the gate insulating layer may return to their original location. When a black image is inserted in every frame by applying the above-mentioned characteristic, the holes accumulated on the gate insulating layer may be removed. In this case, the black image may be directly applied through a data line or the black image may be implemented by blocking the current from being applied to the organic light emitting diode.

In order to completely remove the holes accumulated on the gate insulating layer, a sufficient time is required for the holes to move to their original location. A degree of residual image defect may be determined depending on how many holes that are accumulated on the gate insulating layer are removed.

In the meantime, since a moving speed of the holes is slower than a moving speed of electrons, a black image period which is sufficiently long is necessary. However, when a section of the black image which is inserted in every frame is too long, a flicker defect in which the flickering of the screen is recognized may be caused.

SUMMARY

The inventor of the present disclosure invented a pixel circuit which improves a current passage efficiency indicating how fast the current passes through the active layer by removing holes trapped by the driving transistor, in order to solve or minimize the above-mentioned problems and other limitations associated with the related art.

Accordingly, an object to be achieved by the present disclosure is to provide a display device which applies a reverse current to a driving transistor, thereby improving a restoration residual image and flicker issue.

Another object to be achieved by the present disclosure is to provide a display device with an improved degree of freedom of a pixel design by disposing a circuit for improving an image defect at the outside of the pixel.

Objects of the present disclosure are not limited to the above-mentioned objects, and other objects, which are not mentioned above, can be clearly understood by those skilled in the art from the following descriptions.

According to an aspect of the present disclosure, there is provided an organic light emitting display device. The organic light emitting display device includes an organic light emitting diode disposed between a first node and a second power source, a driving transistor disposed between the first node and a first power source and driving the organic light emitting diode, a first transistor transmitting a data signal to the driving transistor, and a first control transistor disposed between the first node and a second node, in which the first control transistor is turned on during a first period and a voltage of the second node is higher than a voltage of the first power source during the first period.

According to another aspect of the present disclosure, there is provided an organic light emitting display device. The organic light emitting display device includes an organic light emitting diode connected between a first node and a second power source, a driving transistor disposed between the first node and a first power source and driving the organic light emitting diode, a first transistor transmitting a data signal to the driving transistor, and a first control transistor applying a reverse current to the driving transistor, in which the first control transistor and the first transistor may be configured to be commonly connected to the second node.

According to the present disclosure, holes trapped in the gate insulating layer are removed at a high speed by applying a reverse current to the driving transistor.

According to the present disclosure, the reverse current is applied to the driving transistor, so that a current passage efficiency of the active layer is improved and a residual image and flicker issues are addressed or minimized.

According to the present disclosure, a circuit for improving an image defect is disposed at the outside of the pixel, so that an aperture and a degree of freedom of a pixel design may be improved.

Objects of the present disclosure are not limited to the above-mentioned objects, and other objects, which are not mentioned above, can be clearly understood by those skilled in the art from the following descriptions.

The objects to be achieved by the present disclosure, the means for achieving the objects, and effects of the present disclosure described above do not specify essential features of the claims, and, thus, the scope of the claims is not limited to the disclosure of the present disclosure.

BRIEF DESCRIPTION OF THE DRAWINGS

The above and other aspects, features and other advantages of the present disclosure will be more clearly understood from the following detailed description taken in conjunction with the accompanying drawings, in which.

DETAILED DESCRIPTION OF THE EMBODIMENTS

Figure 1:
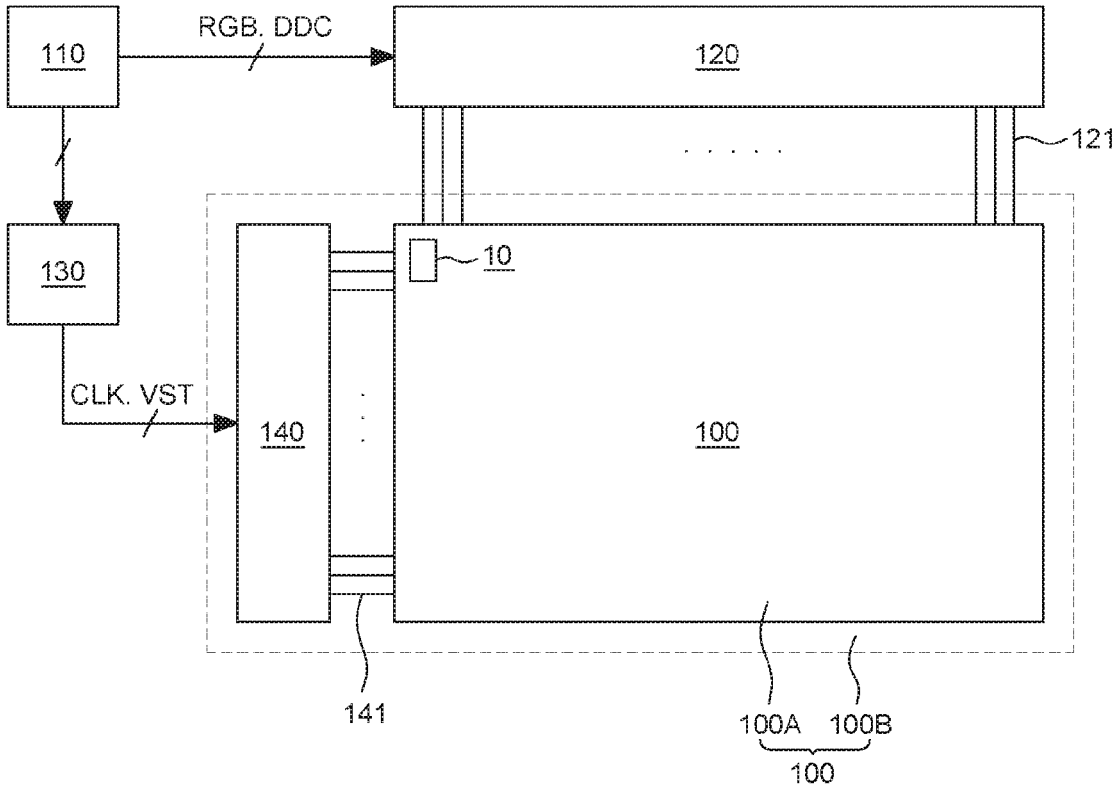
FIG. 1 is a schematic block diagram of a display device according to an embodiment of the present disclosure.

Advantages and characteristics of the embodiments of the present disclosure, and a method of achieving the advantages and characteristics will be clear by referring to exemplary embodiments described below in detail together with the accompanying drawings. However, the present disclosure is not limited to exemplary embodiment disclosed herein but will be implemented in various forms. The exemplary embodiments are provided by way of example only so that a person of ordinary skilled in the art can fully understand the disclosures of the present disclosure and the scope of the present disclosure. Therefore, the present disclosure will be defined only by the scope of the appended claims.

The shapes, sizes, ratios, angles, numbers, and the like illustrated in the accompanying drawings for describing the exemplary embodiments of the present disclosure are merely examples, and the present disclosure is not limited thereto. Like reference numerals generally denote like elements throughout the specification. Further, in the following description of the present disclosure, a detailed explanation of known related technologies may be omitted to avoid unnecessarily obscuring the subject matter of the present disclosure. The terms such as "including," "having," and "consist of" used herein are generally intended to allow other components to be added unless the terms are used with the term "only". Any references to singular may include plural unless expressly stated otherwise. Components are interpreted to include an ordinary error range even if not expressly stated.

When the position relation between two parts is described using the terms such as "on", "above", "below", and "next", one or more parts may be positioned between the two parts unless the terms are used with the term "immediately" or "directly" is not used. If it is described that a component is "connected", "coupled" or "accessed" to another component, it is understood that the component is directly connected or coupled to the other component but another component may be interposed between each component, or another component may be "connected", "coupled" or "accessed" between the components.

Although the terms "first", "second", and the like are used for describing various components, these components are not confined by these terms. These terms are merely used for distinguishing one component from the other components. Therefore, a first component to be mentioned below may be a second component in a technical concept of the present disclosure.

A size and a thickness of each component illustrated in the drawing are illustrated for convenience of description, and the present disclosure is not limited to the size and the thickness of the component illustrated.

Hereinafter, various exemplary embodiments of the present disclosure will be described in detail with reference to accompanying drawings.

FIG. 1 is a schematic block diagram of a display device according to an exemplary embodiment of the present disclosure. All the components of the display device according to all embodiments of the present disclosure are operatively coupled and configured.

Referring to FIG. 1, the display device includes a display panel 100, a timing controller 110, a data driver 120, and scan drivers 130 and 140. The display device is preferably an organic light emitting display device, but may be of other types.

The display panel 100 includes a plurality of pixels 10 which are divided by data lines 121 and scan lines 141 intersecting each other and are connected to the corresponding data lines 121 and the corresponding scan lines 141. The display panel 100 includes a display area 100A in which the pixels 10 are defined and a non-display area 100B in which various signal lines or pads are formed at the outside of the display area 100A.

At least one or each pixel 10 includes a transistor connected to the scan line 141 or the data line 121 and a pixel circuit which operates in response to a scan signal and a data signal supplied by the transistor.

The timing controller 110 receives a timing signal such as a vertical synchronization signal, a horizontal synchronization signal, a data enable signal, or a dot clock through a receiving circuit such as an LVDS or TMDS interface connected to an image board. The timing controller 110 generates timing control signals to control an operation timing of the data driver 120 and the scan drivers 130 and 140 on the basis of the input timing signal.

The data driver 120 includes a plurality of source drive integrated circuits (IC). The source drive ICs are supplied with digital video data RGB and a source timing control signal DDC from the timing controller 110. The source drive ICs convert the digital video data RGB into a gamma voltage in response to the source timing control signal DDC to generate a data voltage and supplies the data voltage to the pixel 10 through the data lines 121 of the display panel 100. The source drive ICs are connected to the data lines 121 of the display panel 100 through a chip on glass (COG) process or a tape automated bonding (TAB) process. The source drive ICs may be formed on the display panel 100, or formed on a separate PCB substrate to be connected to the display panel 100.

The scan drivers 130 and 140 include a level shifter 130 and a shift register 140. The level shifter 130 shifts levels of clock signals CLK which are input at a level of transistor-transistor-logic (TTL) of 0 V to 3.3V from the timing controller 110 and then supplies the clock signals to the shift register 140. The shift register 140 may be formed in the non-display area 100B of the display panel 100 in a gate-in-panel (GIP) manner as a thin film transistor. The shift register 140 is configured by stages which shift the scan signal in accordance with the clock signals CLK and the start signal VST to output the shifted scan signal. The stages included in the shift register 140 sequentially output scan signals through a plurality of output terminals.

The scan signals are formed of a gate high voltage VGH and a gate low voltage VGL. When the shift register 140 outputs the gate high voltage VGH through the output terminal, the scan line 141 of the display panel 100 receives the gate high voltage VGH to emit light from the pixel. Since after emitting light from the pixel, a data signal to be transmitted to a next pixel should not be input thereto, the scan signal of the stage output terminal of the shift register 140 which is connected to the pixel which emits light needs to be maintained at the gate low voltage VGL.

A driving current which is to be supplied to the organic light emitting diode is determined according to the data signal Vdata transmitted through the plurality of data lines 121 and a plurality of pixels 10 may emit light with different luminance.

Figure 2:
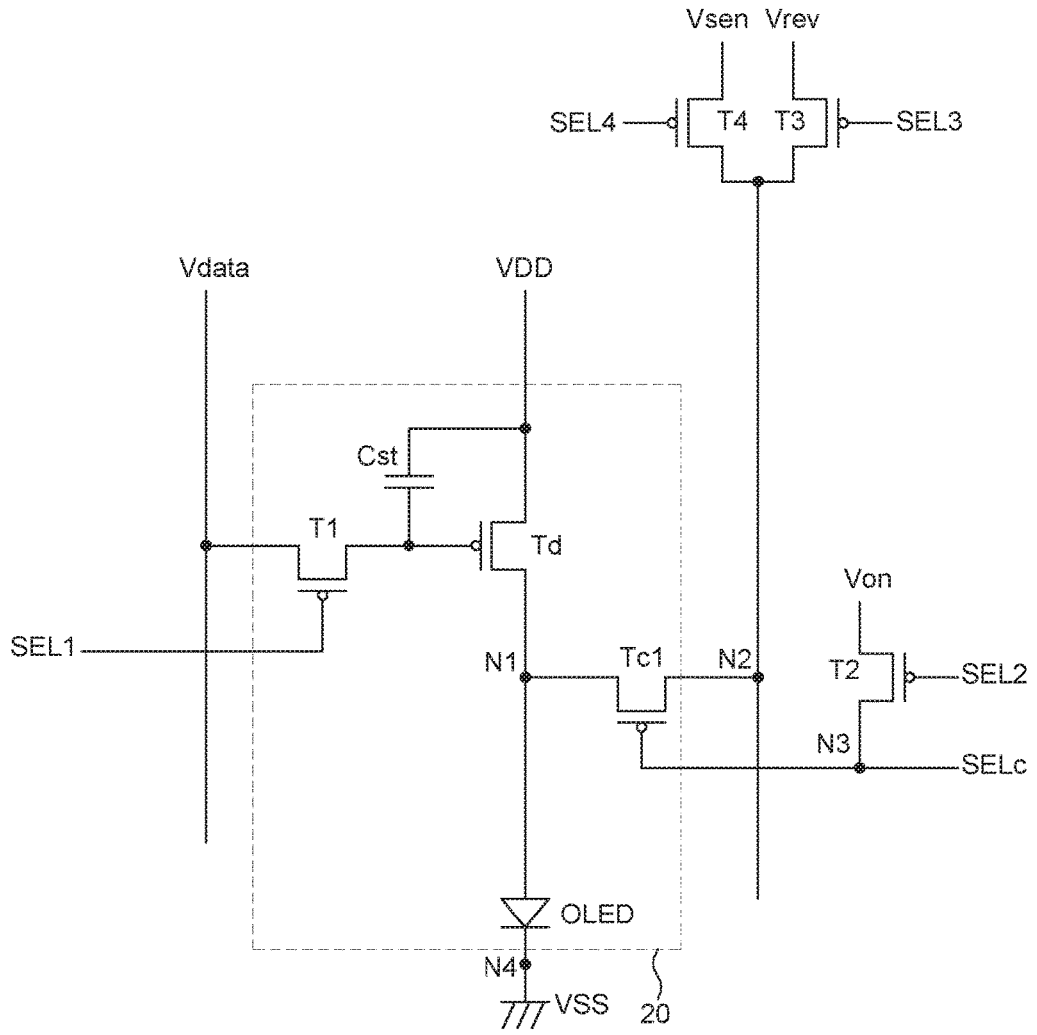
FIG. 2 is a circuit diagram of an example of a pixel illustrated in FIG. 1.

FIG. 2 is a circuit diagram according to an exemplary embodiment of the pixel illustrated in FIG. 1. For instance, a piexl 20 in FIG. 2 is an example of the pixel 10 in FIG. 1.

Referring to FIG. 2, the pixel 20 includes a first transistor T1, a driving transistor Td, an organic light emitting diode OLED, a first control transistor Tc1, and a storage capacitor Cst.

A gate electrode of the first transistor T1 is connected to a first scan signal SEL1, a source electrode is connected to a data signal Vdata, a drain electrode is connected to a first electrode of the storage capacitor Cst and a gate electrode of the driving transistor Td.

The first scan signal SEL1 is transmitted from the scan line 141 of the scan driver 140 and the data signal Vdata is transmitted from the data line 121 of the data driver 120.

The first scan signal SEL1 which is applied to the gate electrode of the first transistor T1 is formed of the gate high voltage VGH and the gate low voltage VGL. When the first scan signal SEL1 is the gate low voltage VGL, the first transistor T1 is turned on.

More specifically, the first transistor T1 is turned on during a period when a gate-source voltage Vgs which is a difference between the gate voltage and the source voltage is lower than a threshold voltage Vth.

When the first transistor T1 is turned on, the data signal Vdata of the data line 121 moves to the drain electrode of the first transistor T1.

The driving transistor Td is disposed between a first power source VDD and a first node N1. A gate electrode of the driving transistor Td is connected to the drain electrode of the first transistor T1, a source electrode is connected to the first power source VDD, and a drain electrode is connected to the first node N1.

The driving transistor Td transmits the first power source VDD to the first node N1 in accordance with the data signal Vdata transmitted by the first transistor T1.

A first electrode of the storage capacitor Cst is connected to the drain electrode of the first transistor T1 and the gate electrode of the driving transistor Td and a second electrode of the storage capacitor Cst is connected to the first power source VDD.

Generally, the capacitor stores a voltage in accordance with a voltage difference of both electrodes for a particular period. Accordingly, the storage capacitor Cst illustrated in FIG. 2 stores the gate-source voltage Vgs which is a difference value between the data voltage Vdata transmitted by the first transistor T1 and the first power source VDD.

Further, the driving transistor Td is turned on in accordance with the gate-source voltage Vgs stored in the storage capacitor Cst and an amount of current generated in the driving transistor Td is determined depending on the magnitude of the gate-source voltage Vgs.

The organic light emitting diode OLED is disposed between the first node N1 and a second power source VSS and an anode electrode is connected to the first node N1 and a cathode electrode is connected to the second power source VSS.

When the driving transistor Td is turned on, an amount of current which is applied to the first node N1 is determined by the voltage stored in the storage capacitor Cst. Further, the current of the first node N1 flows to the organic light emitting diode OLED so that the organic light emitting diode OLED emits light. In this case, the brightness of the organic light emitting diode OLED is determined in accordance with a current amount of the first node N1.

When the driving transistor Td is turned on, electric charges move to an active layer of the driving transistor Td. During this process, some of holes are attracted to the potential of the gate electrode to be trapped by the active layer. As a period when the driving transistor Td is turned on becomes longer and an intensity of the current becomes stronger, more holes may be trapped by the active layer. The trapped holes may interrupt the flow of the electric charges and thus luminance to be represented by the display device may not be satisfactorily implemented. Accordingly, the image distortion may be generated for every frame period, which may cause an image quality problem such as a residual image.

In order to improve the image quality as described above, the trapped holes need to be removed from the active layer. The inventor of the present disclosure invented a method for removing the trapped holes by applying a reverse current to the driving transistor Td.

Referring to FIG. 2, the first control transistor Tc1 is disposed between the first node N1 and the second node N2. The gate electrode of the first control transistor Tc1 is connected to a third node N3, the source electrode is connected to the second node N2, and the drain electrode is connected to the first node N1.

Figure 3:
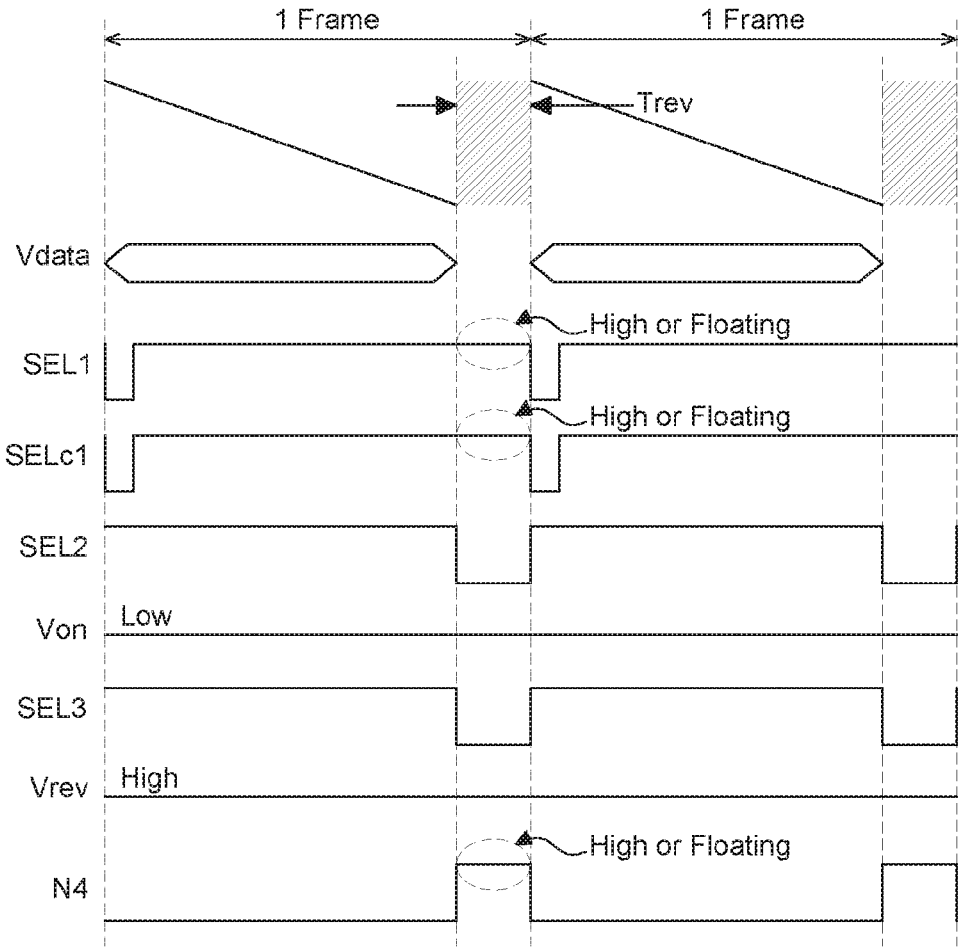
FIG. 3 is a schematic timing chart of a circuit illustrated in FIG. 2.

FIG. 3 is a schematic timing chart of a circuit illustrated in FIG. 2.

A configuration of an exemplary embodiment of the present disclosure will be described in detail with reference to FIGS. 2 and 3. However, a position and a width of a waveform illustrated in FIG. 3 are merely examples, but the present disclosure is not limited thereto.

The first scan signal SEL1 is a signal which controls to transmit the data signal Vdata to the driving transistor Td in relation to emission of the organic light emitting diode OLED. Further, a first control scan signal SELc1 is a signal which controls the first control transistor Tc1 to sense a voltage of the first node N1.

Referring to FIGS. 2 and 3, the first scan signal SEL1 and the first control scan signal SELc1 control different transistors, but both may be the same signal. For example, the first scan signal SEL1 and the first control scan signal SELc1 may be connected to the same line among outputs of the scan driver 140.

Further, the first scan signal SEL1 and the first control scan signal SELc1 may be different signals. For example, the first scan signal SEL1 may be an output of a first shift register and the first control scan signal SELc1 may be an output of a second shift register.

Referring to FIG. 3, the first scan signal SEL1 is represented by high impedance or floating during a first period Trev when the reverse current is applied to the driving transistor Td, but the present disclosure is not limited thereto. During the first period Trev, the first scan signal SEL1 is configured to be maintained at a high potential voltage so that the first transistor T1 is turned off.

The first period Trev when the reverse current is applied to the driving transistor Td may be located at an ending part of the frame, but the present disclosure is not limited thereto. The first period TreV may be located in the middle of one frame and the first period Trev may not be repeated in every frame.

During the first period Trev, the first control transistor Tc1 charges the first node N1 with the voltage of the second node N2 which is higher than that of the first power source VDD. Therefore, the current is generated in a direction from the first node N1 to the first power source VDD and the reverse current flows through the driving transistor Td.

An intensity of the reverse current which is applied to the driving transistor Td may be approximately 100 nA at maximum. The numerical value is an amount of current which is applied when the organic light emitting diode OLED emits light with the maximum brightness and may be increased in accordance with a device characteristic of the organic light emitting diode OLED. In order to effectively remove holes accumulated on the active layer, a reverse current may be applied at the same level as the amount of current when the light is emitted. Further, a length of the first period Trev when the reverse current is applied to the driving transistor Td is desirably between 0.5% and 20% of one frame.

During the first period Trev when the reverse current is applied to the driving transistor Td, the organic light emitting diode OLED may not emit light. When the current which is generated by the first control transistor Tc1 during the first period Trev flows in the organic light emitting diode OLED, the organic light emitting diode OLED may emit light with unintended luminance.

Therefore, the cathode electrode of the organic light emitting diode OLED may be configured to be changed to a high impedance status or a floating status as illustrated in FIG. 3, during the first period Trev when the reverse current is applied to the driving transistor Td. To this end, a separate switch is added to a terminal of the cathode electrode of the organic light emitting diode OLED to select one of the second power source VSS and the high impedance status or one of the second power source VSS and the floating status.

However, it is not necessarily limited that the organic light emitting diode OLED does not emit light during the first period Trev. A circuit may be configured such that during the period when the reverse current is applied to the driving transistor Td, the organic light emitting diode OLED emits light with the same luminance in accordance with the data signal transmitted by the data driver 120. In this case, the circuit may be configured to simultaneously apply the reverse current to the driving transistor Td and cause the organic light emitting diode OLED to emit light.

In order to control a timing at which the first control transistor Tc1 is turned on, a second transistor T2 may be added. The second transistor T2 is disposed between a third power source Von and a third node N3.

In FIG. 2, the first control transistor Tc1 is a P type semiconductor so that a voltage of the third power source Von may be a constant voltage signal which is configured by a logic low potential to turn on the first control transistor Tc1. Alternatively, the voltage of the third power source may be a signal configured by a logic low potential only during the first period Trev when the reverse current is applied to the driving transistor Td.

Referring to FIG. 2, the gate electrode of the first control transistor Tc1 is connected to the second transistor T2 and the first control scan signal SELc1. For external compensation, the first control scan signal SELc1 includes a timing at which a voltage of the first node is sensed and the second transistor T2 includes a timing at which the reverse current is applied to the driving transistor Td.

In order to apply the reverse current to the driving transistor Td, the first control transistor Tc1 is turned on during the first period Trev. To this end, the first control scan signal SELc1 may be changed to the high impedance status or the floating status during the first period Trev. As described above, when the third node N3 becomes the high impedance status or the floating status by the first control scan signal SELc1, the potential of the third node N3 may be determined by the second transistor T2.

Referring to FIG. 3, the second transistor T2 is turned on by the second scan signal SEL2 during the first period Trev. Further, the third power source Von which is connected to the drain electrode of the second transistor T2 during the first period Trev is a low voltage, so that the third node N3 is discharged during the first period Trev.

Since the third node N3 is discharged to be in a low voltage status, the first control transistor Tc1 is turned on. During the first period Trev, the first control transistor Tc1 transmits the voltage of the second node N2 to the first node N1.

In this case, the voltage of the second node N2 is higher than that of the first power source VDD. Therefore, a current path is formed from the second node N2 to the first power source VDD.

The current applied to the driving transistor Td flows from the first node N1 to the first power source VDD, which is an opposite direction to the current in the period when the organic light emitting diode OLED emits light. During the period when the organic light emitting diode OLED emits light, a current path is formed from the first power source VDD to the first node N1.

In the meantime, the second node N2 is connected commonly to a third transistor T3 and a fourth transistor T4.

A gate electrode of the third transistor T3 is connected to a fourth scan signal SEL3, a source electrode is connected to a fourth power source Vrev, and a drain electrode is connected to the second node N2.

The third transistor T3 is turned on during the first period Trev to transmit a voltage of a fourth power source Vrev to the second node N2. The fourth power source Vrev may be configured by a constant voltage which is higher than that of the first power source VDD.

Referring to FIG. 3, the second scan signal SEL2 and the third scan signal SEL3 may be equal to each other during the first period Trev and turn on the second transistor T2 and the third transistor T3 during the first period Trev.

A gate electrode of the fourth transistor T4 is connected to the fourth scan signal SEL4, a source electrode is connected to the second node N2, and a drain electrode is connected to a fifth power source Vsen. The fourth transistor T4 is turned on in accordance with the fourth scan signal SEL4 to transmit the signal of the second node N2 to the drain electrode.

During a period when the third transistor T3 is turned on, the first control transistor Tc1 is also turned on. In this case, the voltage of the fourth power source Vrev moves to the first node N1 via the third transistor T3 and the first control transistor Tc1.

Further, also during the period when the fourth transistor T4 is turned on, the first control transistor Tc1 may be turned on. In this case, the voltage of the first node N1 may pass through the first control transistor Tc1 and the fourth transistor T4 to move to the drain electrode.

As described above, a turn-on period of the first control transistor Tc1 may temporally overlap a turn-on period of the third transistor T3 or the fourth transistor T4. However, the turn-on period of the third transistor T3 does not temporally overlap the turn-on period of the fourth transistor T4.

The fourth transistor T4 may be used to sense the voltage or the current of the first node N1. Further, the voltage or the current of the first node N1 is transmitted to a separate circuit unit which is disposed at the outside of the pixel to be used to compensate deterioration of the driving transistor Td.

The fourth transistor T4 may operate before shipping the product or after supplying a power source after shipment. Further, the fourth transistor T4 may be configured to be turned off all the time if necessary.

The driving transistor Td, the first transistor T1, the first control transistor Tc1, and the storage capacitor Cst are disposed in the pixel 20. In contrast, the second transistor T2, the third transistor T3, and the fourth transistor T4 are disposed at the outside of the pixel 20.

Specifically, the second transistor T2 may be disposed in the scan driver 140. Further, the third transistor T3 and the fourth transistor T4 may be disposed in the data driver 120.

Figure 4:
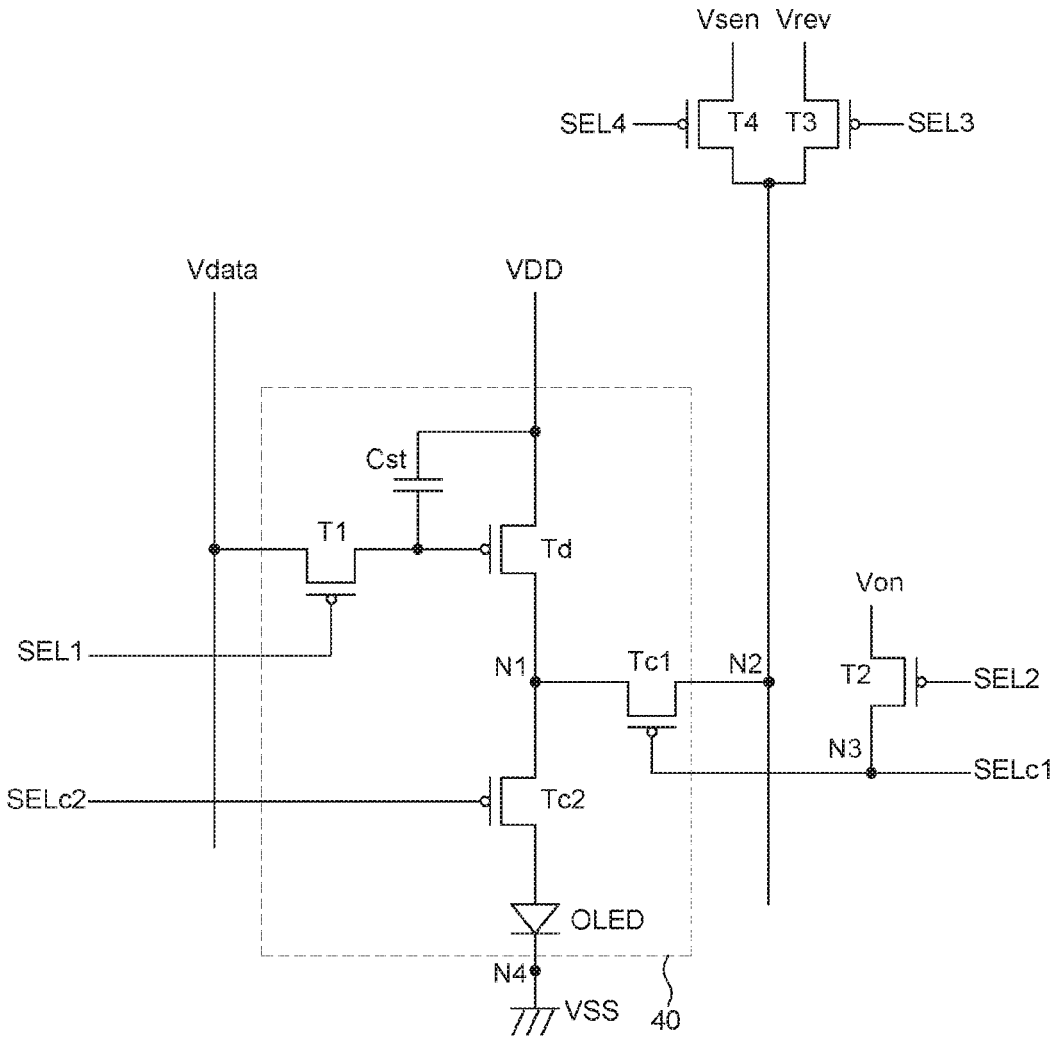
FIG. 4 is a circuit diagram of an example of a pixel illustrated in FIG. 1.
Figure 5:
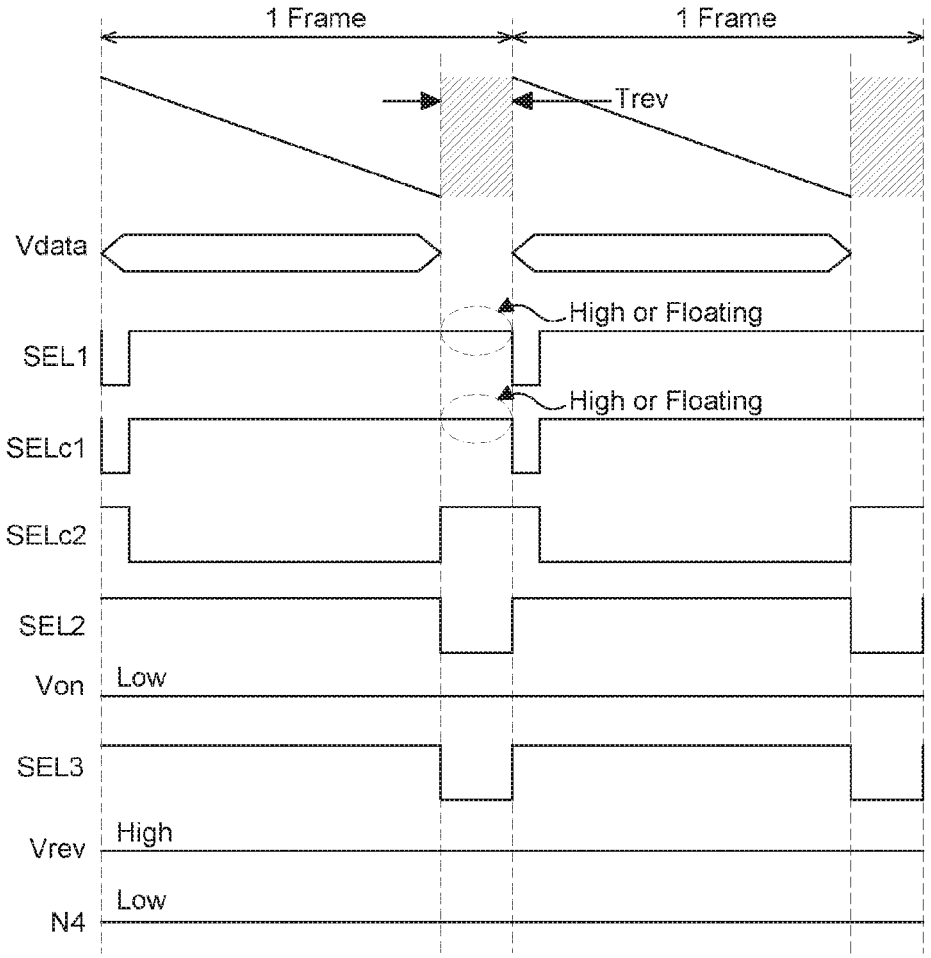
FIG. 5 is a schematic timing chart of a circuit illustrated in FIG. 4.

FIG. 4 is a circuit diagram according to an exemplary embodiment of a pixel illustrated in FIG. 1. FIG. 5 is a schematic timing chart of a circuit illustrated in FIG. 4. For instance, a piexl 40 in FIG. 4 is an example of the pixel 10 in FIG. 1.

Referring to FIG. 4, the pixel 40 includes an organic light emitting diode OLED, a first transistor T1, a driving transistor Td, a first control transistor Tc1, a second control transistor Tc2, and a storage capacitor Cst. A connection relationship and a waveform of the first transistor T1, the driving transistor Td, the first control transistor Tc1, and the storage capacitor Cst are the same as described with reference to FIG. 2, so that a description thereof will be omitted or may be brief.

The second control transistor Tc2 is disposed between a first node N1 and an anode electrode of the organic light emitting diode OLED. A gate electrode of the second control transistor Tc2 is connected to a second control scan signal SELc2, a source electrode is connected to the first node N1, and a drain electrode is connected to an anode electrode of the organic light emitting diode OLED.

The second control transistor Tc2 determines whether to apply a current of the first node N1 to the anode electrode of the organic light emitting diode OLED. That is, the second control transistor Tc2 controls the organic light emitting diode OLED to be turned on or off during the turn-on period of the driving transistor Td.

The driving transistor Td controls an amount of current applied to the first node N1 and the second control transistor Tc2 determines whether to apply the current of the first node N1 to the organic light emitting diode OLED.

Referring to FIG. 5, while the first scan signal SEL1 is maintained at the low voltage, the first control scan signal SELc1 is also maintained at the low voltage. The first transistor T1 is turned on by the first scan signal SEL1 and the data signal Vdata is transmitted to the driving transistor Td. Further, in the driving transistor Td, a current in accordance with a magnitude of the data signal Vdata is formed. In this case, the low voltage of the first control scan signal SELc1 turns on the first control transistor Tc1. Further, the voltage of the first node N1 may move to the outside through the second node N2.

In the meantime, during the above-described period, the second control scan signal SELc2 is maintained at a high voltage and thus the second control transistor Tc2 is turned off. Accordingly, the organic light emitting diode OLED does not emit light.

After a particular time, the second control scan signal SELc2 is changed to the low voltage and the second control transistor Tc2 is turned on. As described above, after the first transistor T1 is turned on for a particular time, the second control transistor Tc2 is turned on. When the second control transistor Tc2 is turned on, the organic light emitting diode OLED emits light.

When the first scan signal SEL1 and the second control scan signal SELc2 are configured to have the above-described timing, a sufficient time to charge the storage capacitor Cst with a desired voltage may be provided. That is, the voltage corresponding to the data signal Vdata may be charged in the storage capacitor Cst with a sufficient time. When the organic light emitting diode OLED emits light after sufficiently charging the storage capacitor, an image with an improved contrast ratio (CR) may be obtained.

Referring to FIG. 5, during a first period Trev when the reverse current is applied to the driving transistor Td, the second control transistor Tc2 is turned off so that no current may be applied to the organic light emitting diode OLED. When it is configured as described above, the cathode electrode of the organic light emitting diode OLED may be connected to the second power source VSS all the time.

A position of the second control transistor Tc2 is not limited between the first node N1 and the anode electrode of the organic light emitting diode OLED. The second control transistor Tc2 may be disposed in any section where the current path is formed between the first power source VDD and the second power source VSS.

During the first period Trev when the reverse current is applied to the driving transistor Td, holes trapped by the active layer or the gate insulating layer of the driving transistor Td are removed. Accordingly, the current may quickly pass through the active layer without being interrupted by the trapped holes, so that residual image and flicker effects may be addressed or minimized.

Figure 6:
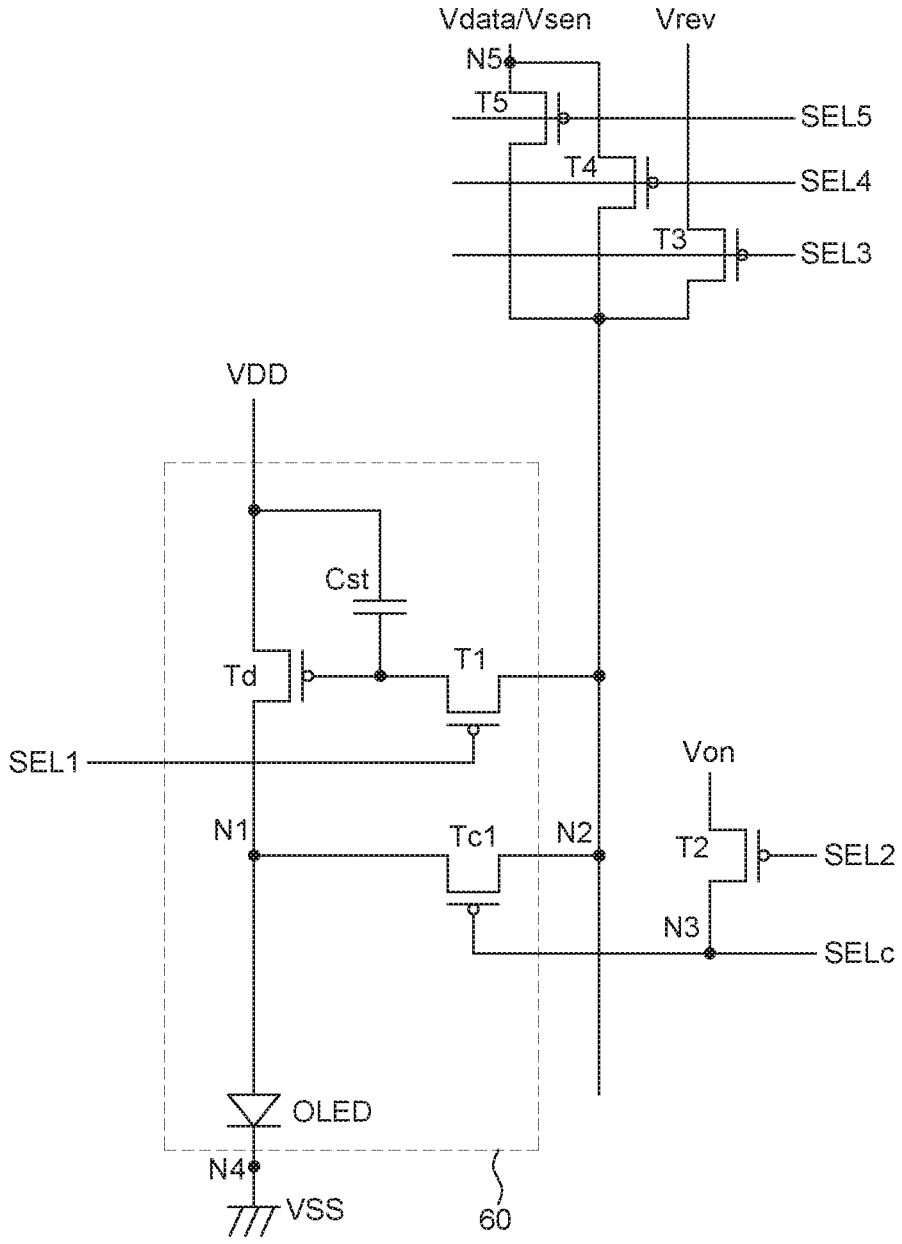
FIG. 6 is a circuit diagram of an example of a pixel illustrated in FIG. 1.

FIG. 6 is a circuit diagram according to an exemplary embodiment of a pixel illustrated in FIG. 1. For instance, a piexl 60 in FIG. 6 is an example of the pixel 10 in FIG. 1.

Referring to FIG. 6, the pixel 60 includes a first transistor T1, a driving transistor Td, an organic light emitting diode OLED, a first control transistor Tc1, and a storage capacitor Cst.

Referring to FIG. 6, a signal line through which a data signal is transmitted to the first transistor, a signal line through which a voltage of a first node N1 is transmitted to a fourth transistor T4, and a signal line through which a voltage of a fourth power source Vrev is transmitted to the first control transistor Tc1 may be combined as one signal line. Further, the signal lines may be connected to each other through the second node N2.

When three signal lines are combined as one signal line as described above, a pixel 10 in the display area 100A and a peripheral part of the pixel 10 may be easily designed in FIG. 1.

In FIG. 6, a position and a connection relationship of the driving transistor Td, the first control transistor Tc1, the second transistor T2, the third transistor T3, and the fourth transistor T4 are the same as described with reference to FIG. 2, so that a description thereof will be omitted or will be brief.

Referring to FIG. 6, the first transistor T1 is disposed between the driving transistor Td and the second node N2. A gate electrode of the first transistor T1 is connected to the first scan signal SEL1, a source electrode is connected to the second node N2, and a drain electrode is connected to a gate electrode of the driving transistor Td.

The source electrode of the first transistor T1 and the source electrode of the first control transistor Tc1 are commonly connected to the second node N2. Further, the second node N2 is commonly connected to a drain electrode of the third transistor T3, a source electrode of the fourth transistor T4, and a drain electrode of the fifth transistor T5.

One signal line including the second node N2 is used to transmit three types of signals. In order to use one signal line for different types of signals, the signals may be transmitted to the signal line at different timings. To this end, the third transistor T3, the fourth transistor T4, and the fifth transistor T5 are used. In this case, turn-on periods of the third transistor T3, the fourth transistor T4, and the fifth transistor T5 may be configured so as not to temporally overlap each other.

The third transistor T3 is turned on during the first period Trev and transmits a voltage of a fourth power source Vrev to the second node N2. Further, the first control transistor Tc1 is turned on during the first period Trev so that a voltage of a fourth power source Vrev of the second node N2 transmitted by the third transistor T3 is transmitted to the first node.

The cathode electrode of the organic light emitting diode OLED is not connected to the second power source VSS illustrated in FIG. 6 during the first period Trev and is controlled to be a high impedance status or a floating status. To this end, a switch may be added between the fourth node N4 and the second power source VSS. The fourth node N4 may be connected to any one of the second power source VSS, the high impedance status, and the floating status by the switch.

Therefore, during the first period Trev when the third transistor T3 and the first control transistor Tc1 are simultaneously turned on, a current path is formed from the fourth power source Vrev to the driving transistor Td. Further, due to the status of the fourth node N4, the current path is not formed from the fourth power source Vrev to the organic light emitting diode OLED.

Therefore, a direction of a reverse current formed in the driving transistor Td during the first period Trev is opposite to a direction of a current formed in the driving transistor Td when the organic light emitting diode OLED emits light.

During the first period Trev when the reverse current is applied to the driving transistor Td, holes trapped by the active layer or the gate insulating layer of the driving transistor Td are removed. Accordingly, the current may quickly pass through the active layer without being interrupted by the trapped holes, so that residual image and flicker effects may be addressed or minimized.

The fifth transistor T5 is turned on during the second period and transmits the data signal Vdata to the second node N2. Further, the first transistor T1 transmits the data signal Vdata of the second node N2 to the gate electrode of the driving transistor Td during the second period.

The fourth transistor T4 is turned on together with the first control transistor Tc1 during a third period to transmit the voltage of the first node N1 to a fifth node N5.

Figure 7:
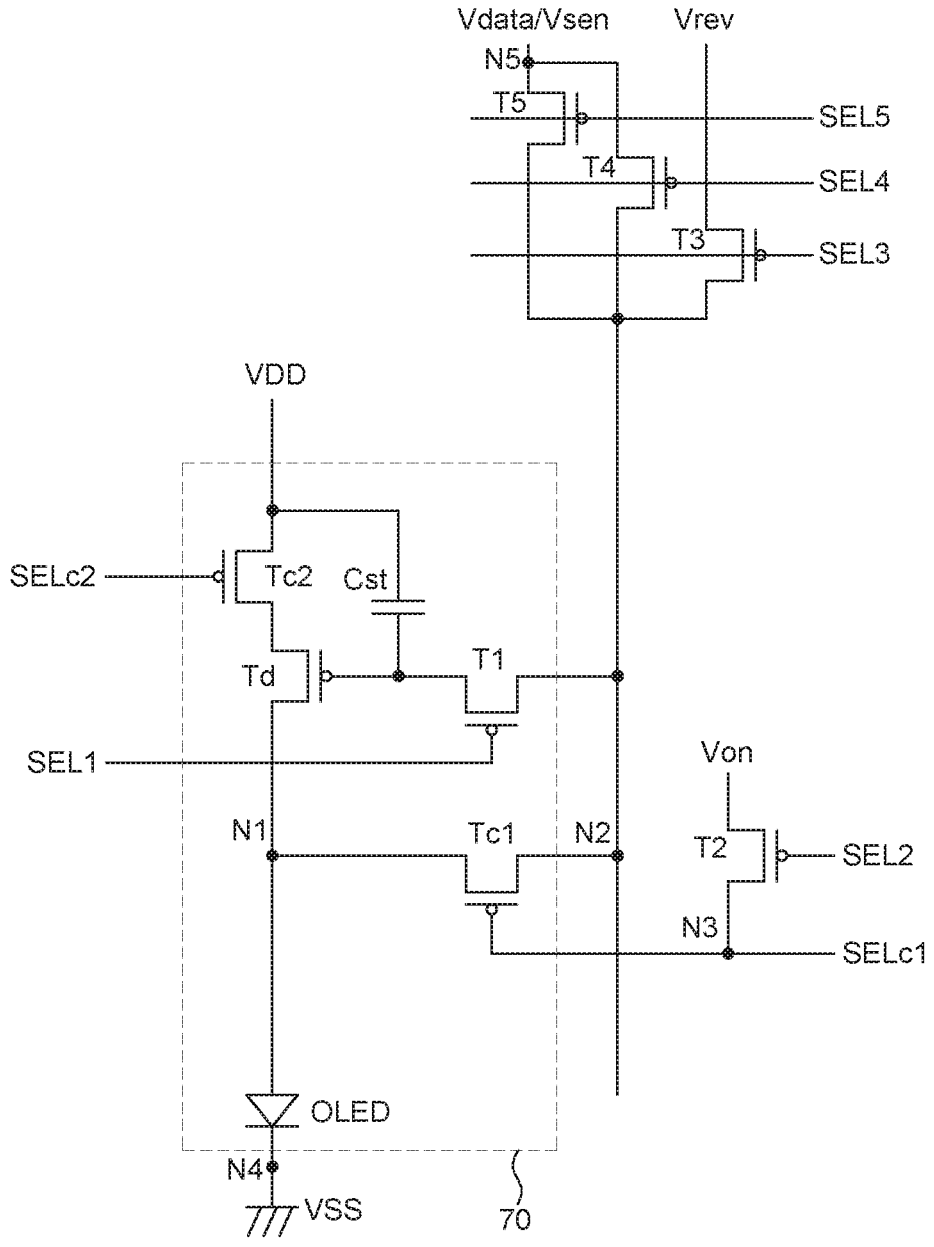
FIG. 7 is a circuit diagram of an example of a pixel illustrated in FIG. 1.

FIG. 7 is a circuit diagram according to an exemplary embodiment of the pixel 10 illustrated in FIG. 1. For instance, a piexl 70 in FIG. 7 is an example of the pixel 10 in FIG. 1.

The pixel 70 of FIG. 7 includes an organic light emitting diode OLED, a first transistor T1, a driving transistor Td, a first control transistor Tc1, a second control transistor Tc2, and a storage capacitor Cst. A connection relationship of the first transistor T1, the driving transistor Td, the first control transistor Tc1, and the storage capacitor Cst is the same as described with reference to FIG. 6, so that a description thereof will be omitted or will be brief.

The second control transistor Tc2 may be disposed between a first power source VDD and the driving transistor Td. A gate electrode of the second control transistor Tc2 is connected to a second control scan signal SELc2, a source electrode is connected to a first power source VDD, and a drain electrode is connected to a source electrode of the driving transistor Td.

The second control transistor Tc2 controls a timing at which the current is applied to the organic light emitting diode OLED.

A fifth transistor T5 and the first transistor T1 are turned on to charge the storage capacitor Cst with a voltage corresponding to a data signal Vdata. In this case, the second control transistor Tc2 is turned off to block the organic light emitting diode OLED from emitting light.

In the meantime, the driving transistor Td is turned on in accordance with the gate-source voltage Vgs charged in the storage capacitor Cst. Further, the second control transistor Tc2 is turned on to apply a current to the organic light emitting diode OLED.

As described above, when the timing at which the current is applied to the organic light emitting diode OLED is separated from an operation period of the first transistor T1, an image with an improved contrast ratio may be obtained.

During the first period Trev, the second control transistor Tc2 is turned on so that a reverse current flows through the driving transistor Td.

During the first period Trev when the reverse current is applied to the driving transistor Td, holes trapped by the active layer or the gate insulating layer of the driving transistor Td are removed. Accordingly, the current may quickly pass through the active layer without being interrupted by the trapped holes, so that residual image and flicker effects may be addressed.

Figure 8:
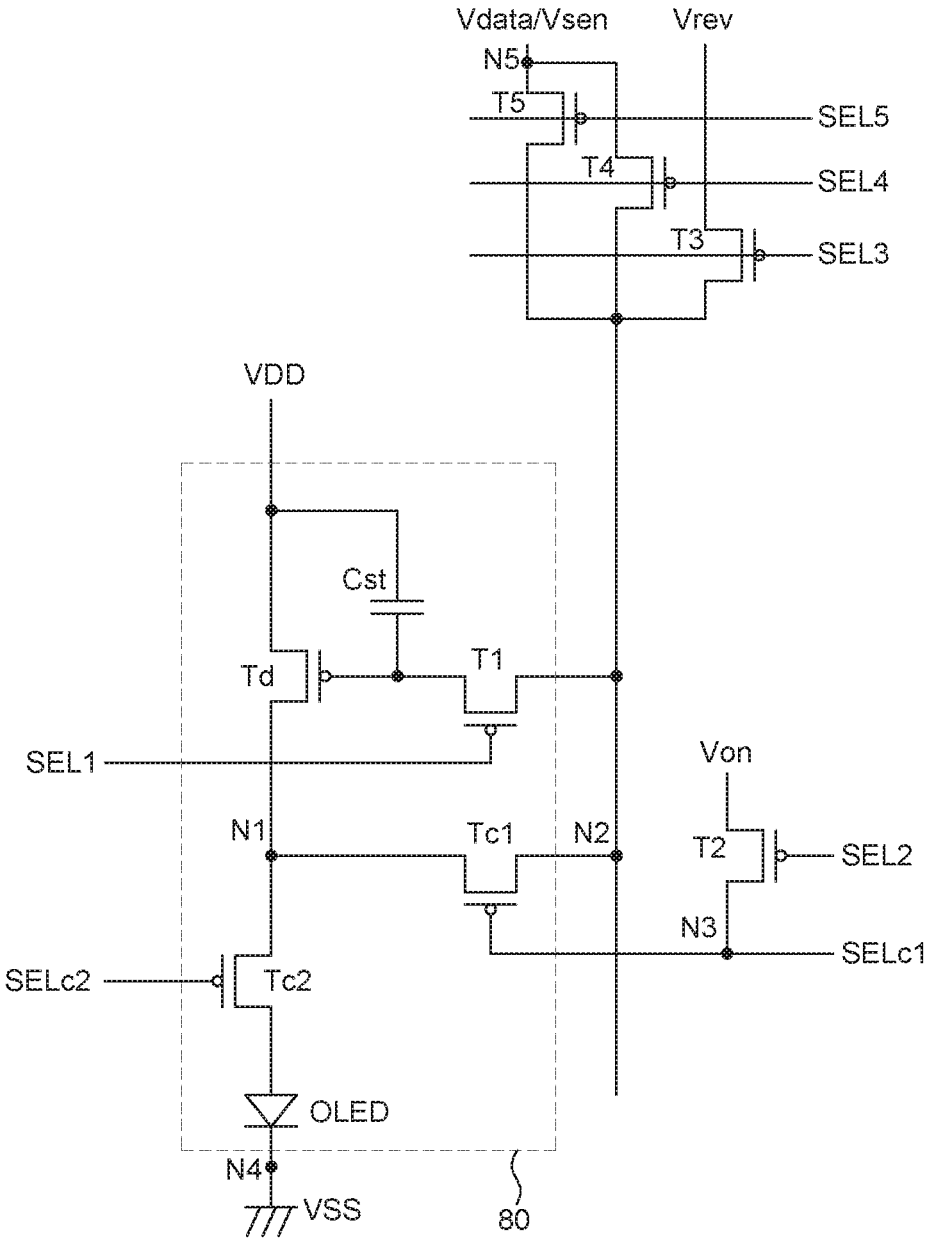
FIG. 8 is a circuit diagram of an example of a pixel illustrated in FIG. 1.

FIG. 8 is a circuit diagram according to an exemplary embodiment of the pixel 10 illustrated in FIG. 1. For instance, a piexl 80 in FIG. 8 is an example of the pixel 10 in FIG. 1.

The pixel 80 of FIG. 8 includes a first transistor T1, a driving transistor Td, a first control transistor Tc1, a second control transistor Tc2, and a storage capacitor Cst. A connection relationship of the first transistor T1, the driving transistor Td, the first control transistor Tc1, and the storage capacitor Cst is the same as described with reference to FIG. 6, so that a description thereof will be omitted or will be brief.

The second control transistor Tc2 may be disposed between the first node N1 and an anode electrode of the organic light emitting diode OLED. A gate electrode of the second control transistor Tc2 is connected to a second control scan signal SELc2, a source electrode is connected to a first node N1, and a drain electrode is connected to an anode electrode of the organic light emitting diode OLED.

The second control transistor Tc2 is turned on when the organic light emitting diode OLED emits light. In contrast, during a period when a reverse current is applied to the driving transistor Td, the second control transistor Tc2 is controlled to be turned off.

During the first period Trev when the reverse current is applied to the driving transistor Td, holes trapped by the active layer or the gate insulating layer of the driving transistor Td are removed. Accordingly, the current may quickly pass through the active layer without being interrupted by the trapped holes, so that residual image and flicker effects may be addressed or minimized.

A position of the second control transistor Tc2 is not limited to the above-described exemplary embodiment. The second control transistor Tc2 may be disposed in any position where the current path is formed between the first power source VDD and the second power source VSS.

The embodiments of the present disclosure can also be described as follows.

According to an aspect of the present disclosure, a display panel includes an organic light emitting diode connected between a first node and a second power source, a driving transistor disposed between the first node and a first power source and driving the organic light emitting diode, a first transistor transmitting a data signal to the driving transistor, and a first control transistor disposed between the first node and a second node, in which the first control transistor is configured to be turned on during a first period and a voltage of the second node is higher than a voltage of the first power source during the first period.

The first control transistor may be configured to apply a reverse current to the driving transistor during the first period.

The display panel may further include a third node connected to a gate electrode of the first control transistor and a second transistor disposed between the third node and a third power source and the second transistor may be configured to be turned on during the first period to discharge the third node.

The display panel may further include a third transistor disposed between a fourth power source and the second node.

The third transistor may be configured to charge the second node with a voltage of the fourth power source during the first period.

The display panel may further include a fourth transistor connected to the second node and the fourth transistor may be configured to transmit a voltage of the second node to a drain electrode of the fourth transistor during a second period.

The first period and the second period may be configured without overlapping at the same time.

The display panel may further include a fourth node connected to a cathode electrode of the organic light emitting diode, and a multiplexer unit disposed between the fourth node and the second power source, and the multiplexer unit may be configured to convert the fourth node to be a high impedance status or a floating status during the first period.

The display panel may further include a second control transistor disposed between the first node and the organic light emitting device.

The second control transistor may be turned off during the first period and control the current so as not to flow into the organic light emitting device.

According to an another aspect of the present disclosure, an organic light emitting display device includes an organic light emitting diode connected between a first node and a second power source, a driving transistor disposed between the first node and a first power source and driving the organic light emitting diode, a first transistor transmitting a data signal to the driving transistor, and a first control transistor controlling to apply a current to the driving transistor, in which the first control transistor and the first transistor may be commonly connected to the second node.

The first control transistor is configured to apply a reverse current to the driving transistor during a first period and a current path efficiency of the driving transistor is improved during the first period, and a residual image and flickers are minimized.

During the first period, a voltage of the second node may be higher than a voltage of the first power source.

The organic light emitting display device may further include a third node connected to a gate electrode of the first control transistor and a second transistor which discharges the third node during the first period.

The organic light emitting display device may further include a third transistor which charges the second node with a compensation voltage during the first period and the compensation voltage may be higher than the voltage of the first power source.

The organic light emitting display device may further include a fifth transistor which charges the second node with the data signal during the second period and the first period and the second period may be configured without overlapping at the same time.

The organic light emitting display device may further include a fourth transistor which senses a voltage of the second node during a third period and the third period may be configured without overlapping at the same time with the first period and the second period.

The organic light emitting display device may further include a second control transistor between the first power source and the second power source and the second control transistor may be configured to control the organic light emitting diode to emit light.

The second control transistor may be disposed between the first power source and the driving transistor and a cathode electrode of the organic light emitting diode may be configured to be maintained at a high impedance status during the first period.

The second control transistor may be disposed between the first node and the organic light emitting diode and configured to be turned off during the first period.

Although the exemplary embodiments of the present disclosure have been described in detail with reference to the accompanying drawings, the present disclosure is not limited thereto and may be embodied in many different forms without departing from the technical concept of the present disclosure. Therefore, the exemplary embodiments of the present disclosure are provided for illustrative purposes only but not intended to limit the technical aspects of the present disclosure. The scope of the technical aspects of the present disclosure is not limited thereto. Therefore, it should be understood that the above-described exemplary embodiments are illustrative in all aspects and do not limit the present disclosure. The protective scope of the present disclosure should be construed based on the following claims, and all the technical concepts in the equivalent scope thereof should be construed as falling within the scope of the present disclosure.

What is claimed is:

1. An organic light emitting display device, comprising:
an organic light emitting diode connected between a first node and a second power source;
a driving transistor disposed between the first node and a first power source, and driving the organic light emitting diode;
a first transistor configured to transmit a data signal to the driving transistor;
a first control transistor disposed between the first node and a second node;
a third node connected to a gate electrode of the first control transistor; and
a second transistor disposed between the third node and a third power source,
wherein the first control transistor is configured to be turned on during a first period,
wherein a voltage of the second node is higher than a voltage of the first power source during the first period, and
wherein the second transistor is configured to be turned on during the first period to discharge the third node.

2. The organic light emitting display device according to claim 1, wherein the first control transistor is configured to apply a reverse current to the driving transistor during the first period.

3. The organic light emitting display device according to claim 1, further comprising:
a third transistor disposed between a fourth power source and the second node.

4. The organic light emitting display device according to claim 3, wherein the third transistor is configured to charge the second node with a voltage of the fourth power source during the first period.

5. The organic light emitting display device according to claim 3, further comprising:
a fourth transistor connected to the second node and configured to transmit a voltage of the second node to a drain electrode of the fourth transistor during a second period.

6. The organic light emitting display device according to claim 5, wherein the first period and the second period are configured so as not to temporally overlap each other.

7. The organic light emitting display device according to claim 1, further comprising:
a fourth node connected to a cathode electrode of the organic light emitting diode; and
a multiplexer unit disposed between the fourth node and the second power source,
wherein the multiplexer unit is configured to convert the fourth node to be at a high impedance status or a floating status during the first period.

8. The organic light emitting display device according to claim 1, further comprising:
a second control transistor disposed between the first node and the organic light emitting diode.

9. The organic light emitting display device according to claim 8, wherein the second control transistor is turned off during the first period and controls a current so as not to flow into the organic light emitting diode.

10. An organic light emitting display device, comprising:
an organic light emitting diode connected between a first node and a second power source;
a driving transistor disposed between the first node and a first power source, and configured to drive the organic light emitting diode;
a first transistor configured to transmit a data signal to the driving transistor; and
a first control transistor configured to control a current to be applied to the driving transistor,
wherein the first control transistor and the first transistor are commonly connected to the second node, and
wherein the first control transistor is configured to apply a reverse current to the driving transistor during a first period and a current path efficiency of the driving transistor is improved during the first period, whereby residual image and flicker characteristics are reduced.

11. The organic light emitting display device according to claim 10, wherein a voltage of the second node is higher than a voltage of the first power source during the first period.

12. The organic light emitting display device according to claim 10, further comprising:
a third node connected to a gate electrode of the first control transistor; and
a second transistor configured to discharge the third node during the first period.

13. The organic light emitting display device according to claim 10, further comprising:
a third transistor configured to charge a compensation voltage to the second node during the first period,
wherein the compensation voltage is higher than the voltage of the first power source.

14. The organic light emitting display device according to claim 13, further comprising:
a fifth transistor configured to charge the data signal to the second node during the second period,
wherein the first period and the second period are configured without overlapping at a same time.

15. The organic light emitting display device according to claim 14, further comprising:
a fourth transistor configured to sense a voltage of the second node during a third period,
wherein the third period is configured without overlapping at the same time with the first period and the second period.

16. The organic light emitting display device according to claim 10, further comprising:
a second control transistor between the first power source and the second power source,
wherein the second control transistor is configured to control the organic light emitting diode to emit light.

17. The organic light emitting display device according to claim 16, wherein the second control transistor is disposed between the first power source and the driving transistor, and a cathode electrode of the organic light emitting diode is configured to be maintained at a high impedance status during the first period.

18. The organic light emitting display device according to claim 16, wherein the second control transistor is disposed between the first node and the organic light emitting diode and is configured to be turned off during the first period.

* * * * *